US005499644A

United States Patent [19]

Geniele

[11] Patent Number: 5,499,644

[45] Date of Patent: Mar. 19, 1996

[54] SUNSHADE ASSEMBLY

[75] Inventor: Henry Geniele, Westmount, Canada

[73] Assignee: Tye-Sil Corporation, Montreal, Canada

[21] Appl. No.: 451,070

[22] Filed: May 25, 1995

[51] Int. Cl.[6] ..... A45B 11/00

[52] U.S. Cl. ..... 135/20.1; 135/21; 248/159; 248/418; 403/103

[58] Field of Search ..... 135/19.5, 20.1, 135/20.3, 21; 248/159, 415, 418; 403/355, 84, 103, 305

[56] References Cited

U.S. PATENT DOCUMENTS

| | | | |
|---|---|---|---|
| 2,559,421 | 7/1951 | Garrett | 403/84 X |
| 3,120,238 | 2/1964 | Glatz . | |
| 3,218,021 | 11/1965 | Michalshi | 248/415 X |
| 3,304,035 | 2/1967 | Davis | 135/20.1 X |
| 3,345,786 | 10/1967 | Buzzella et al. | 135/20.1 X |
| 3,765,434 | 10/1973 | Riggs | 135/20.1 |
| 4,428,554 | 1/1984 | Hartman | 248/415 |
| 4,565,395 | 1/1986 | Rockwood et al. | 248/415 X |
| 4,586,525 | 5/1986 | Glatz et al. . | |
| 4,674,523 | 6/1987 | Glatz . | |

FOREIGN PATENT DOCUMENTS

| | | |
|---|---|---|
| 2430234 | 1/1975 | Germany . |
| 3229776 | 4/1993 | Germany . |

*Primary Examiner*—Lanna Mai
*Attorney, Agent, or Firm*—Robic

[57] ABSTRACT

A sunshade assembly in which the sunshade covering or umbrella can easily be adjusted to any one of a plurality of angular positions all around a vertical stand which is offset and affixed either to the ground or to a supporting structure. The vertical stand includes an upper part and a lower part that extend upwardly and coaxially one above the other. A first ring is rigidly connected to and radially projects from the bottom end of the upper part. A second ring is rigidly connected to and radially projects from the top end of the lower part. Both of these rings are provided with a plurality of vertical perforations. A locking pin is insertable simultaneously into a selected perforation of the first ring and another selected peroration of the second ring to lock these two rings in the selected angular position.

14 Claims, 3 Drawing Sheets

FIG. 4
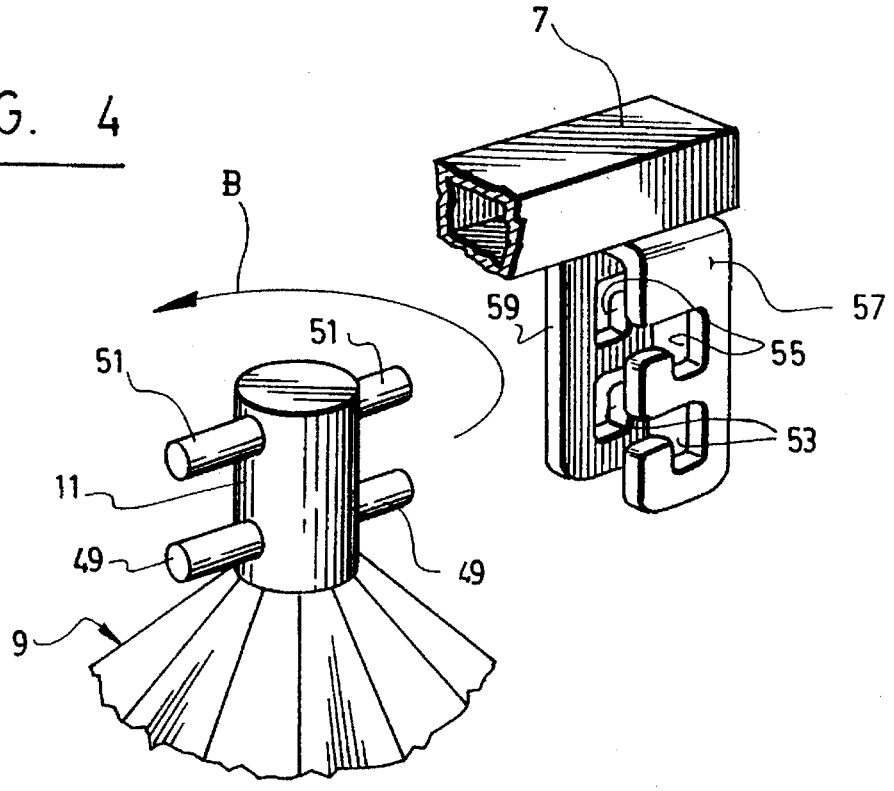
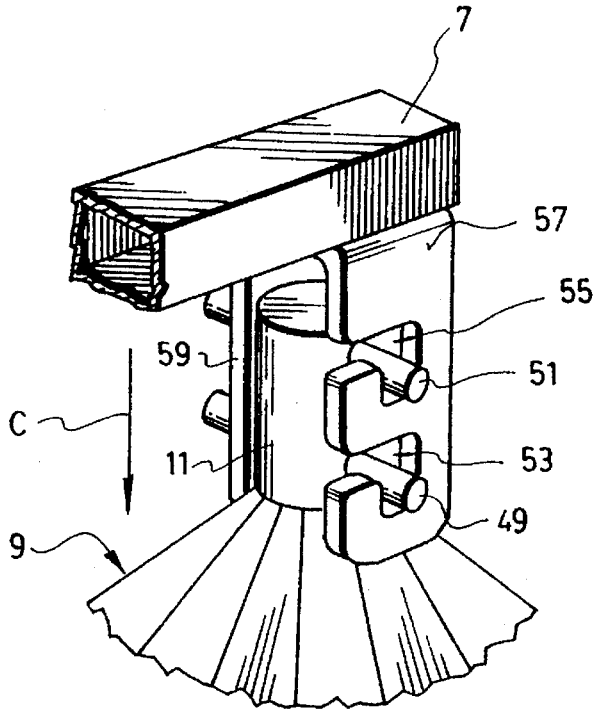
FIG. 5

SUNSHADE ASSEMBLY

BACKGROUND OF THE INVENTION a) Field of the Invention

The present invention relates to improvements to the structure of the sunshade assemblies of the type comprising an off-set stand.

In the following disclosure and claims, reference will be made to sunshade covering and sunshade assemblies exclusively. However, the invention is not restricted to sunshades exclusively and should actually be interpreted as encompassing any kind of umbrellas that can be used outdoors for protecting against sun and/or rain.

b) Brief Description of the Invention

Sunshade assemblies of the type mentioned hereinabove are well known in the art and some of them available on the market. In this connection, reference can be made to U.S. Pat. No. 3,120,238 of 1964; German laid-open application No. 3,229,776 published in 1983; U.S. Pat. No. 4,586,525 of 1986 and U.S. Pat. No. 4,674,523 of 1987, all of which are in the name of GLATZ A.G.

Such an assembly basically comprise a vertical stand that is held by a loaded base or is anchored to a supporting structure. It also comprises a supporting arm that extends radially from the stand. This supporting arm has a free end distant from the stand, to which a sunshade covering of conventional structure is connected.

As compared to the more conventional sunshade assembly provided with a centrally extending post, the sunshade assembly incorporating an off-set stand has the advantage of providing an unobstructed free space under the sunshade covering. However, it has the disadvantage of being rather cumbersome to install and move, because the stand which holds this sunshade covering in a cantilever fashion, must necessarily be rigidly affixed to the ground or any other supporting structure. As a matter of fact, when such an assembly is installed, it is almost impossible to move the sunshade covering mounted onto the supporting arm rigidly connected to the stand from one angular position to another one relative to the stand, so as to adjust the position of the sunshade covering to the position of the sun and/or the user's requirement.

SUMMARY OF THE INVENTION

An object of the present invention is to provide an improved sunshade assembly of the above mentioned type, in which the sunshade covering can easily be adjusted to any one of a plurality of angular positions all around the vertical stand that is affixed to the ground or to a supporting structure.

More particularly, the invention provides a sunshade assembly of the above mentioned type, which is improved in that its vertical stand includes:

- an upper part and a lower part that extend upwardly and coaxially one above the other along a vertical axis that is common to each other;
- means for rotatably connecting the upper and lower parts of the stand in such a manner that these parts are rotatable with respect to each other about their common vertical axis; and
- means for locking the upper and lower parts to a plurality of angular positions with respect to each other about their common vertical axis.

In accordance with the invention, the above mentioned locking means comprises a first ring rigidly connected to and radially projects from a bottom end of the upper part. The locking means also comprises a second ring is rigidly connected to and radially projecting from a top end of the upper part. The locking means further comprises locking means to lock the first and second rings together.

Preferably, the first and second rings are similar and each have with a peripheral portion provided with a plurality of vertical perforations. In such a case, the locking means may consist of a pin insertable simultaneously into a selected one of the perforations of the second ring when these selected perforations of the second ring when these selected perforations are in line.

Thus, the sunshade covering hereinafter called "sunshade" only, can easily be positioned in any selected radial position with respect to the stand, by merely unlocking the first and second rings, then rotating the upper part of the stand with respect to the lower part of the same, and finally locking again the first and second rings.

Advantageously, the sunshade can be of the foldable type, so as to be collapsible for transportation and storage, and expandable to provide the required weather protection.

In such a case, in accordance with another object of the invention, the assembly may further comprise means of the bayonet-joint type for detachably connecting the top end of the sunshade to the free end of the supporting arm. Such means preferably comprise two pairs of pins projecting in opposite directions from the top end of the sunshade, and two corresponding pairs of oppositely-oriented L-shaped slots provided in lateral walls of a supporting bracket attached to the free end of the supporting arm. Insertion, twisting and locking of the pins into their corresponding slots cause the sunshade to be not only hooked onto the supported arm, but also to be prevented from swinging as would be the case if use would be made of only one pair of opposite pins.

The invention and its advantages will be better understood upon reading of the following non-restrictive description of a preferred embodiment thereof, made with reference to the accompanying drawings.

BRIEF DESCRIPTION OF THE DRAWINGS

FIGS. 4 and 5 are perspective view of the bayonet-type joint used to connect the top end of the sunshade to the free end of the supporting arms, in two different positions.

DESCRIPTION OF A PREFERRED EMBODIMENT OF THE INVENTION

Figure 1:
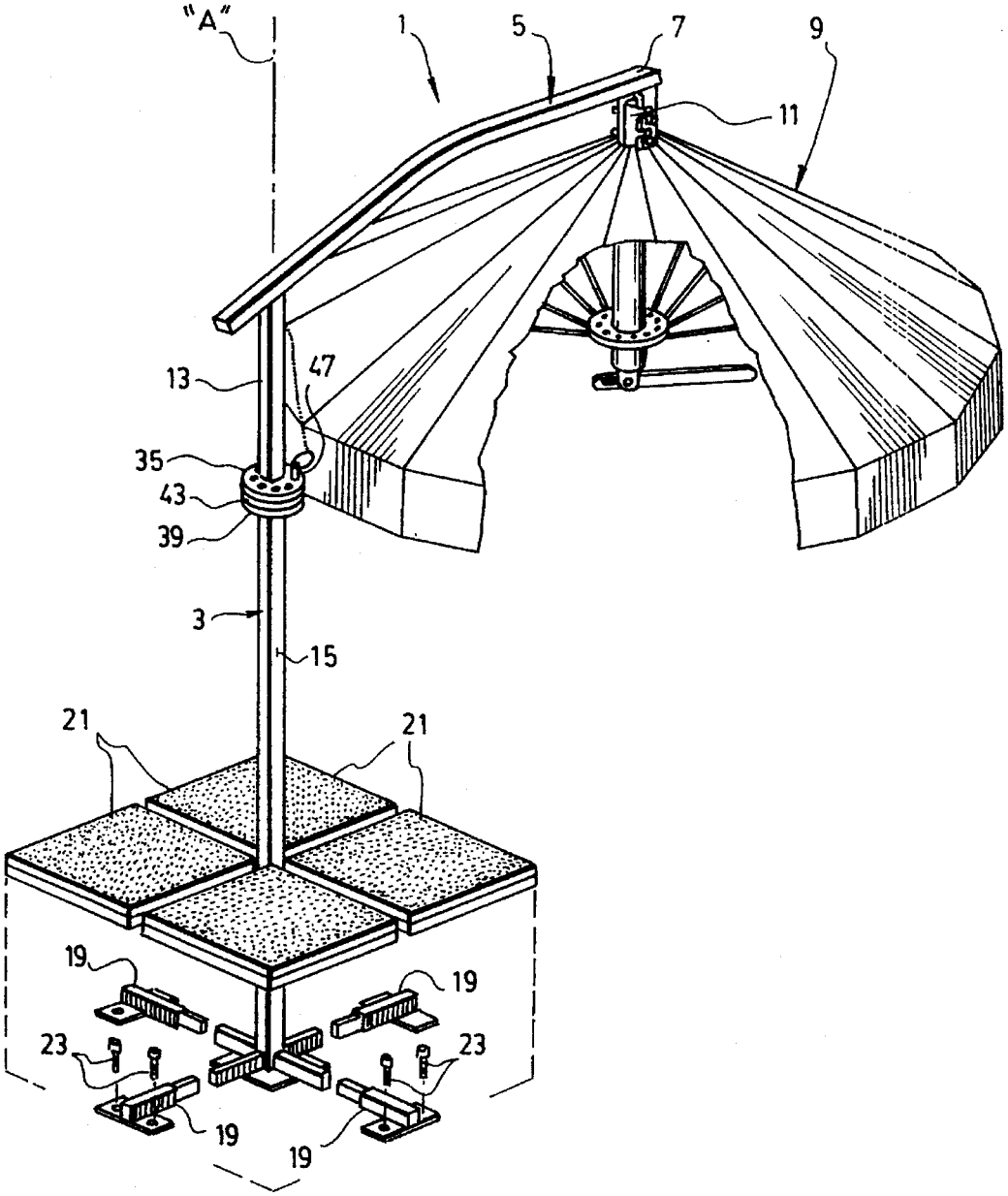
FIG. 1 is a semi-exploded perspective view of a sunshade assembly according to the invention.

The sunshade assembly 1 according to the invention as shown in the accompanying drawings, comprises a vertical stand 3 whose structure will be described in greater detail hereinafter. It also comprises a supporting arm 5 connected to and extending radially from the stand 3. The supporting arm 5 has a free end 7 distant from the stand. The assembly further comprises a sunshade 9 connected to the free end 7 of the arm. As aforesaid, the sunshade 9 is preferably of the foldable type, and is provided with a top end 11. The structure and operation of the sunshade are rather standard (see, for example, U.S. Pat. No. 3,120,238) and need not be further explained.

Figure 2:
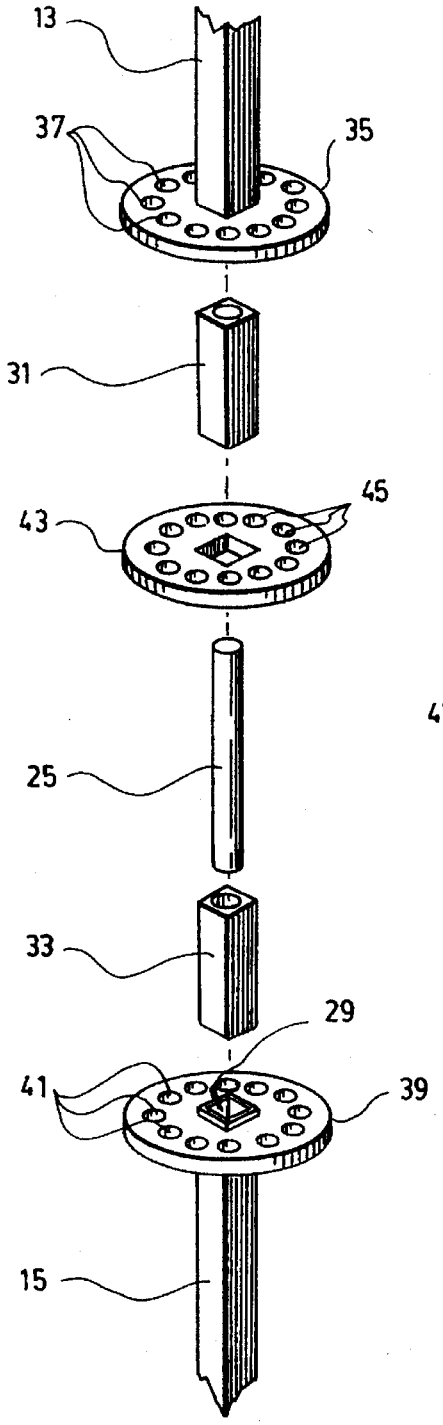
FIG. 2 is an exploded perspective view of the means used to rotatably connect the upper and lowered parts of the stand of the assembly shown in FIG. 1.
Figure 3:
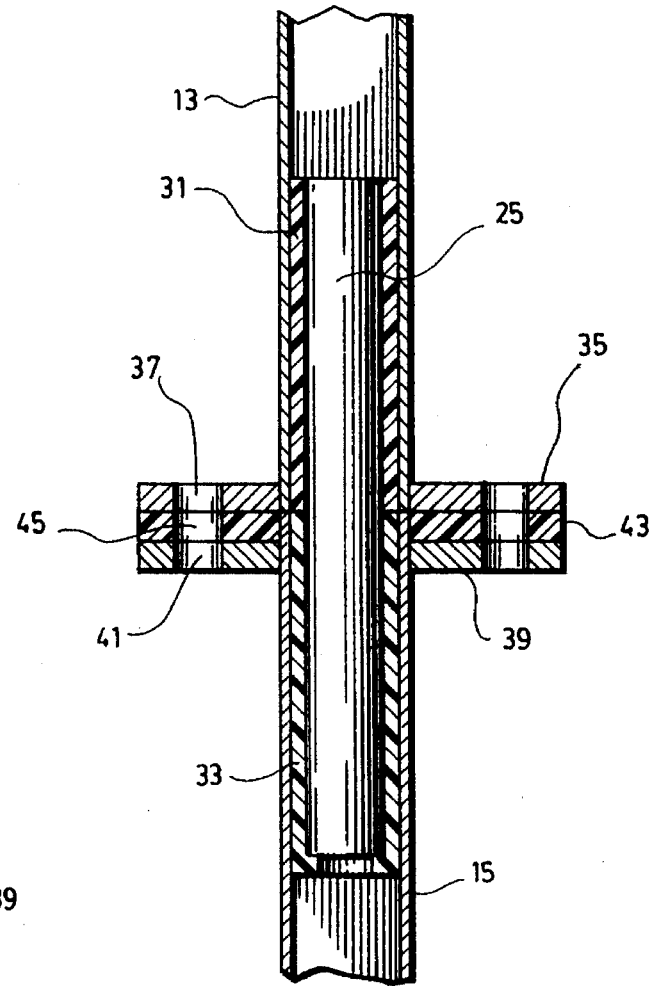
FIG. 3 is a cross-sectional, side elevational view of the means shown in FIG. 2 in assembled form.

As is better shown in FIGS. 1 and 2, the vertical stand 3 is preferably made of steel tubes that are square in cross-section. It basically comprises an upper part 13 and a lower part 15 that extend upwardly and coaxially one above the other along a vertical axis "A" that is common to each other.

Means are provided for anchoring the lower part 15 of the stand to a supporting structure. Such means may consist of brackets to which the lower part can be attached. They may also consists of a rigid tube integral to the supporting structure and into which the bottom end of the lower part 15 can be inserted.

Alternatively, as is shown in the drawings, the lower part 15 of the stand 3 can be connected to a load-receiving base 17 devised to hold the assembly in operative position when it is loaded. Such a base 17 may comprise a set of legs 19 horizontally projecting away from the bottom end of the lower part 15 of the stand. As is shown, the legs 19 are sized and shaped to receive and be loaded with patio tiles 21 or other garden accessories, such as bags of sand or earth or concrete blocks. Means such as bolts 23 may further be provided for anchoring the base or its legs 19 onto the ground.

In accordance with the invention, means are provided for rotatably connecting the upper and lower parts 13, 15 of the stand 3 in such a manner that these parts are rotatable with respect to each other about their common vertical axis "A". Means are also provided or locking the upper and lower parts 13, 15 into a plurality of angular positions with respect to each other about their common vertical axis "A".

As is shown, the means for rotatably connecting the upper and lower parts 13, 15 of the stand may comprise a bar 25 of circular cross-section that is coaxial with the common vertical axis "A". This bar 25 extends through a set of aligned vertical holes 27, 29 provided in the bottom end of the upper part 13 and the top end of the lower part 15, respectively. As is shown, each of the vertical holes 27, 29 is of substantially the same circular cross-section as the bar and extends within a sleeve-shaped piece 31, 33 of low-friction material such a polyethylene, that is inserted into the corresponding end of the corresponding part 13, 15.

As is also shown, the locking means may comprise a first ring 35 having a peripheral portion provided with a plurality of vertical perforations 37. This first ring is preferably made of steel and acts as a "bearing dial". It is rigidly connected to the bottom end of the upper part 13 by welding and radially projects from the same.

The locking means also comprises a second ring 39 similar to the first one, having a peripheral portion with a plurality of vertical perforations 41. This second ring which is also made of steel, is rigidly connected to the top end of the upper part 15 and radially projects from the same.

Advantageously, the locking means may further comprise a third ring 43 made of a low friction material that is non-rotatably mounted onto the top end of the lower part 15 immediately above the second ring 41. For this purpose, the second ring 41 may be welded to the top end of the lower part 15 just a few millimetres below the upper edge of this top end, thereby leaving some room for the third ring 41 that can be provided with a central square-shaped hole sized to fit onto the top end of the square-shaped tube forming the lower part 15. Such a mounting makes the third ring 43 not rotatable with respect to the axis "A".

As is shown, the third ring 43 is preferably similar to the first and second rings 35, 39 and has a peripheral portion provided with a plurality of perforations 45 sized and positioned to match those 37, 41 of the first and second rings.

When installed, the third ring 43 projects radially from the top end of the lower part and acts as a support for the first ring 35 radially projecting from the bottom end of the upper part 13 of the stand 3.

The locking means which comprises the above mentioned rings 35, 39 and 43, may further comprise a locking pin 47 insertable simultaneously into a selected one of the perforations 37 of the first ring 35 and a selected one of the perforations 41 of the second ring 39 via one of the perforations 45 of the third ring 43, which are devised to match with those of the second ring 39. Of course, such insertion can be achieved when the selected perforations are in line, so as to lock these first and second rings together with the arm 5 radially extending in any preselected direction about the axis "A".

In accordance with another aspect of the invention, means of the bayonet-joint type are provided for detachably connecting the top end 11 of the sunshade 9 to the free end 7 of the supporting arm 5.

As is better shown in FIGS. 4 and 5, such means preferably comprises two pairs of pins 49, 51 projecting in opposite directions one above the other from the top end 11 of the sunshade, and two corresponding pairs of L-shaped slots 53, 55 provided in the lateral walls 57, 59 of a supporting bracket attached to the free end 7 of the supporting arm.

Connection of the sunshade 9 to the free end 7 of the arm 5 can be easily achieved by vertically inserting the top end 11 of the sunshade between the walls 57, 59 of the bracket and subsequently twisting this top end as shown with the arrow B before letting it fall down by gravity as shown with the arrow C. This double pairs of pins and slots advantageously cause the sunshade to be not only hooked onto the supported arm, but also prevented from swinging as would be the case if use would be made of only one pair of opposite pins.

Of course, numerous modifications could be made to the above described sunshade assembly without departing from the scope of the present invention. Thus, for example, use could be made of other locking means to lock the rings 35 and 39 together, such as a wise-grip. Use could also be made of other joint means like those disclosed in the above mentioned U.S. and German patents in order to connect the sunshade 9 to the arm 5. Use could further be made of a small winch including a drum attached to the stand so as to be easily accessible and a rope guided with rollers and pulleys along the stand and the arm, in order to lift up the sunshade after the free end of the rope has been connected to top end of the sunshade.

I claim:

1. In a sunshade assembly of the type comprising:

a vertical stand;

a supporting arm connected to and extending radially from the stand, said supporting arm having a free end distant from said stand; and a sunshade connected to the free end of the arm, the improvement wherein the vertical stand includes:

an upper part and a lower part that extend upwardly and coaxially one above the other along a vertical axis that is common to each other;

means for rotatably connecting the upper and lower parts of the stand in such a manner that these parts are rotatable with respect to each other about their common vertical axis; and means for locking said upper and lower parts into a plurality of angular positions with respect to each other about their common vertical axis, said locking means comprising:

a first ring rigidly connected to and radially projecting from a bottom end of said upper part;

a second ring rigidly connected to and radially projecting from a top end of said lower part; and locking means to lock these first and second rings together.

2. The sunshade assembly of claim 1, wherein:

the first ring has a peripheral portion provided with a plurality of vertical perforations;

the second ring is similar to the first one and has a peripheral portion with a plurality of vertical perforations; and said locking means consists of a locking pin insertable simultaneously into a selected one of said perforations of said first ring and a selected one of said perforations of said second ring when said selected perforations are in line.

3. The sunshade assembly of claim 2, wherein said means for rotatably connecting the upper and lower parts of the stand comprises a bar of circular cross-section that is coaxial with said common vertical axis and that extends through a set of aligned vertical holes provided in the bottom end of the upper part and the top end of the lower part, respectively.

4. The sunshade assembly of claim 3, wherein each of said vertical holes is of substantially the same circular cross-section as the bar and extends within a sleeve-shaped piece of low-friction material inserted into the corresponding end of the corresponding part.

5. The sunshade assembly of claim 4, wherein said locking means further comprises a third ring made of a low friction material that is mounted onto the top end of the lower part immediately above the second ring, projecting radially from the top end of said lower part and being sized to act as a support for the first ring radially projecting from the bottom end of the upper part of the stand.

6. The sunshade assembly of claim 5, wherein said third ring is similar to said first and second rings and has a peripheral portion provided with a plurality of perforation sized and portioned to match with those of the first and second rings and with the locking pin.

7. The sunshade assembly of claim 6, wherein said upper and lower parts are square in cross-section and said third ring is detachably mounted onto the end of the lower part in such a manner as to be not rotatable with respect to the said common vertical axis.

8. The sunshade assembly according to claim 3, wherein said sunshade is of the foldable type and comprises a top end, and wherein said assembly further comprises:

means for detachably connecting the top end of the sunshade to the free end of the supporting arm, said sunshade-connecting means being of the bayonet-joint type.

9. The sunshade assembly according to claim 8, wherein said sunshade connecting means comprises two pairs of pins projecting in opposite directions from the top end of the sunshade, and two corresponding pairs of oppositely-oriented, L-shaped slots provided in lateral walls of a supporting bracket attached to the free end of the supporting arm.

10. The sunshade assembly according to claim 3, further comprising:

a load-receiving base to which the lower part of said stand is rigidly connected, said base being devised to hold the assembly in operative position when it is loaded.

11. The sunshade assembly according to claim 10, wherein said base includes a set of legs horizontally projecting away from the lower part of the stand, said legs being sized and shaped to receive and be loaded with patio tiles or other garden accessories.

12. The sunshade assembly according to claim 10, further comprising:

means for anchoring said base onto the ground.

13. The sunshade assembly according to claim 3, further comprising:

means for anchoring the lower part of said stand to a supporting structure.

14. The sunshade assembly according to claim 3, further comprising:

means for anchoring the lower part of said stand to a supporting structure.

* * * * *